US006248000B1

(12) United States Patent
Aiyer

(10) Patent No.: US 6,248,000 B1
(45) Date of Patent: Jun. 19, 2001

(54) POLISHING PAD THINNING TO OPTICALLY ACCESS A SEMICONDUCTOR WAFER SURFACE

(75) Inventor: Arun A. Aiyer, Fremont, CA (US)

(73) Assignee: Nikon Research Corporation of America, Belmont, CA (US)

( * ) Notice: Subject to any disclaimer, the term of this patent is extended or adjusted under 35 U.S.C. 154(b) by 0 days.

(21) Appl. No.: 09/047,322

(22) Filed: Mar. 24, 1998

(51) Int. Cl.[7] ..... B24B 7/22
(52) U.S. Cl. ..... 451/41; 451/6
(58) Field of Search ..... 451/41, 6, 288, 451/287, 533, 534, 530, 921; 438/692, 693

(56) References Cited

U.S. PATENT DOCUMENTS 5,394,655 * 3/1995 Allen et al. ..... 451/548
5,433,651 7/1995 Lustig et al. ..... 451/6
5,605,760 * 2/1997 Roberts ..... 451/527
5,609,511 * 3/1997 Moriyama et al. ..... 451/5
5,637,185 6/1997 Murarka et al. ..... 438/5
5,725,420 * 3/1998 Torii ..... 451/288
5,853,317 * 12/1998 Yamamoto ..... 451/41

* cited by examiner

*Primary Examiner*—Robert A. Rose
(74) *Attorney, Agent, or Firm*—Skjerven Morrill MacPherson LLP; Norman R. Klivans

(57) ABSTRACT

In a CMP method and apparatus an essentially circular polishing pad is mounted on a rotating platen. A region of the polishing pad is thinned to provide enhanced optical transparency. A portion of the platen underlying the thinned pad region is also transparent. The thinned pad and the transparent platen portion provide optical access to the surface of a wafer for in-situ process monitoring. Input signals from optical monitoring instruments enable dynamic process control.

17 Claims, 2 Drawing Sheets

POLISHING PAD THINNING TO OPTICALLY ACCESS A SEMICONDUCTOR WAFER SURFACE

CROSS REFERENCE TO RELATED APPLICATIONS

This application is related to Coon et al.

Application Ser. No. 09/021,767 and Aiyer et al. Application Ser. No. 09/021,740, which are incorporated herein by reference in their entirety.

BACKGROUND

1. Field of the Invention

This invention relates generally to an apparatus and method for planarizing a substrate, and more specifically, to an apparatus and method for in-situ monitoring of chemical-mechanical planarization of semiconductor wafers.

2. Background

Planarization of the active or device surface of a substrate has become an important step in the fabrication of modern integrated circuits (ICs). Of the several methods of planarization that have been developed, Chemical Mechanical Polishing (CMP) is perhaps the most commonly used method. This popularity is due, in part, to its broad range of applicability with acceptably uniform results, relative ease of use, and low cost. However, the move to larger diameter wafers and device technologies that require constant improvement in process uniformity requires that an improved planarization system become available.

A typical CMP system uses a flat, rotating disk or platen with a pliable monolithic polishing pad mounted on its upper surface. As the disk is rotated, a slurry is deposited near the center of the polishing pad and spread outward using, at least in part, centrifugal force caused by the rotation. A wafer or substrate is then pressed against the polishing pad such that the rotating polishing pad moves the slurry over the wafer's surface. In this manner, surface high spots are removed and an essentially planar surface is achieved.

The planarization of an interlayer dielectric is one common use for CMP. As the topology of the underlying surface is not uniform, dielectric surface coating replicates or even magnifies those non-uniformities. Thus, as the surface is planarized, the high spots are removed and then the total thickness of the dielectric is reduced to a predetermined value. Thus, the planarized dielectric layer will be thinner over high points of the underlying surface than over low points of that surface. Typically, it is important to maintain a minimum dielectric thickness over each of the highest points of the underlying layer, both locally (with a die) and globally (across the wafer). Thus, uniform removal of the dielectric layer at all points of the wafer is required.

A problem with most existing CMP systems is their inability to perform in-situ thickness monitoring. As the surface of the wafer is pressed against the polishing pad during removal, typically, no measurements as to the progress of the polishing can be made. Thus, wafers are either polished for fixed times, and/or periodically removed for off-line measurement. Recently, Lustig et al., U.S. Pat. No. 5,433,651 (Lustig) proposed placement of at least one viewing window in the working surface through the thickness of the polishing pad to provide access for in-situ measurement. However, a window placed in a polishing pad creates a mechanical discontinuity in the working surface each time the window passes across the surface of the wafer. A more conventional approach is to use a monolithic polishing pad.

Thus there is a need for a CMP apparatus, and method thereof, that provides optical access to the wafer front surface for continuous in-situ process monitoring, without undue process complexity or expense.

SUMMARY

A CMP method and apparatus for enhanced optical access to the wafer surface in accordance with at least one embodiment of the invention is provided. In some embodiments, an essentially circular polishing pad is mounted on a rotating platen. A region of the polishing pad is thinned to provide enhanced optical transparency and homogeneity. In some embodiments, a portion of the platen underlying at least some of the thinned pad region is optically transparent. In this manner the thinned pad and the underlying transparent portion of the platen advantageously provide optical access to the surface of a substrate for in-situ process monitoring. Since enhanced access is provided for in-situ process monitoring, some embodiments of the invention enable dynamic process control.

In some embodiments, different polishing pads comprise different material compositions. Thus textures, thicknesses, hardnesses, and optical transparencies are varied between polishing pads. In some embodiments, the thinned region of the polishing pad has different shapes, locations, or comprises distributed multiple regions applied to single or multiple pads. In some embodiments, thinning is accomplished from either surface of the polishing pad. However, it is preferable to thin the polishing pad from the platen side, thereby leaving the working surface intact and minimizing any mechanical discontinuity in wafer contact. In some embodiments, the platen has a raised portion aligned and interlocked with the thinned region, thereby providing mechanical support to prevent deformation of the polishing pad. Thus embodiments of the invention provide a system and method for optically accessing a wafer surface to enable enhanced in-situ monitoring of a CMP process.

BRIEF DESCRIPTION OF THE DRAWINGS

The present invention may be better understood, and its numerous objects, features, and advantages made apparent to those skilled in the art, by referencing the accompanying drawings.

DETAILED DESCRIPTION OF THE EMBODIMENTS

As embodiments of the present invention are described with reference to the aforementioned drawings, various modifications or adaptations of the specific structures and or methods may become apparent to those skilled in the art. All such modifications, adaptations, or variations that rely upon the teachings of the present invention, and through which these teachings have advanced the art, are considered to be within the spirit and scope of the present invention.

Figure 1:
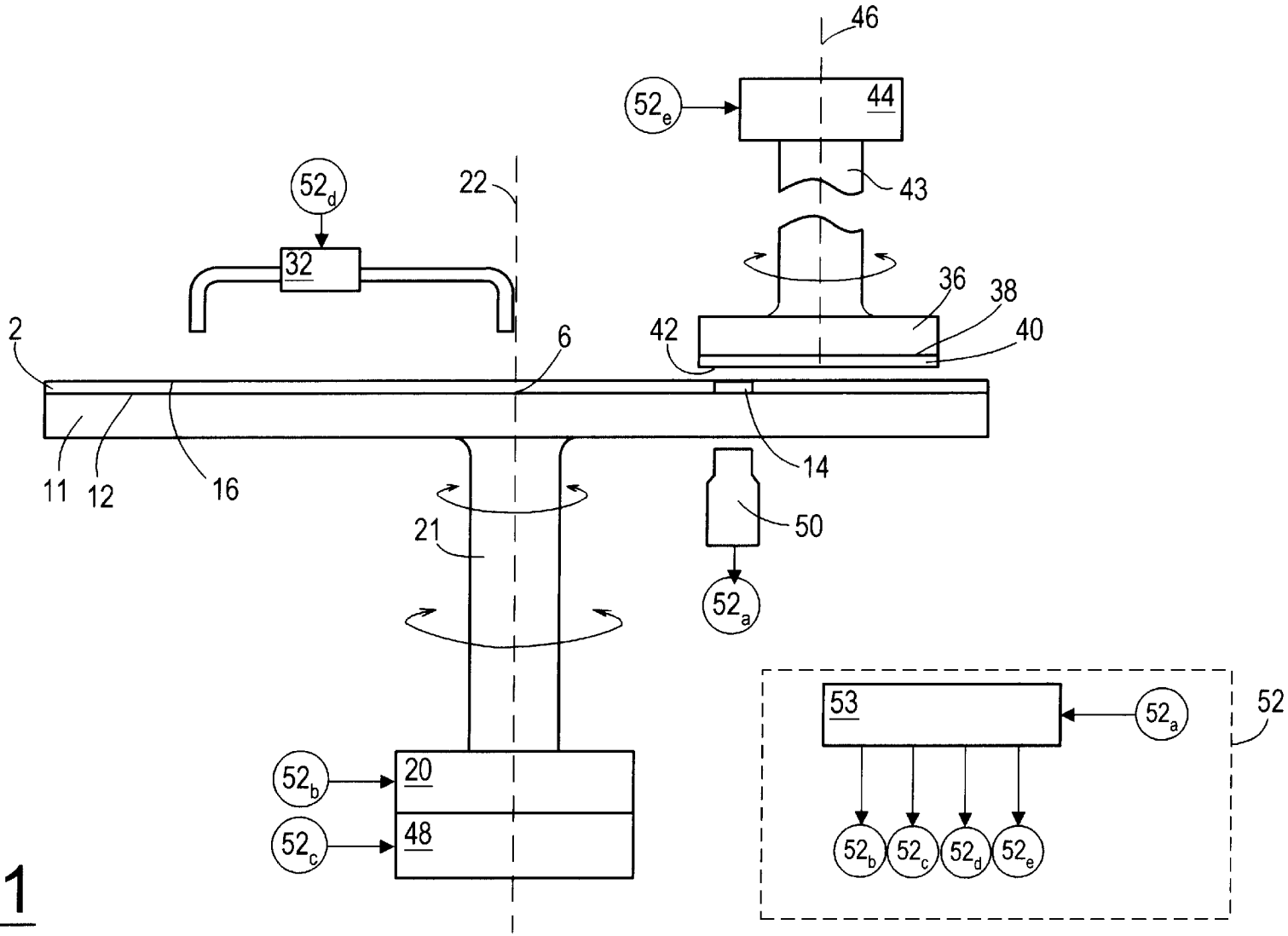
FIG. 1 is a cross-sectional view showing a portion of a CMP apparatus having a thinned polishing pad in accordance with the invention.

FIG. 1 is a cross-sectional view showing a portion of a CMP apparatus of the present invention having a thinned polishing pad. A platen 11 is rotatable about a perpendicular first axis 22 through a center point 6. A polishing pad 2 having a working surface 16 is pasted or otherwise attached using conventional methods to a planar surface 12 of platen 11. A region 14 of polishing pad 2 is thinned from the side facing planar surface 12 of platen 11 to provide enhanced optical transparency and homogeneity. Thinned region 14 provides enhanced optical access for a sensor device to perform in-situ process monitoring, as described in detail below.

For ease and simplicity of understanding only, the descriptions herein are directed to embodiments having a single thinned region 14. It is to be understood, however, that while not shown, other embodiments having multiple thinned regions in one or more polishing pads are within the scope and spirit of the present invention.

In some embodiments, different polishing pads comprise different material compositions. Thus textures, thicknesses, hardnesses, and optical transparencies are varied between polishing pads. A typical optically transparent polishing pad material is porous polyurethane. In some embodiments, the thinned region of the polishing pad has different shapes, locations, or comprises distributed multiple regions applied to single or multiple polishing pads. Illustratively, some embodiments have thinned region shapes including rectangular, circular, oblong, and annular. In some embodiments, thinning is accomplished from either surface of the polishing pad. However, it is preferable to thin the polishing pad from the platen side, thereby leaving working surface 16 continuous and thus minimizing any mechanical discontinuity in surface contact that could result.

Additionally, it will be understood that descriptions herein of component mechanisms, devices, or elements in embodiments having a single thinned region can be applied to embodiments having multiple thinned regions. And, unless specifically stated, no component mechanism, device, or element of embodiments of the present invention described as having any relationship with a single polishing pad 2 is limited to a relationship solely with single polishing pad 2. For example, in some embodiments multiple thinned regions (not shown) are formed when multiple polishing pads (not shown) are positioned on platen 11.

Still referring to FIG. 1, a platen drive mechanism 20 is coupled to platen 11 through a drive coupling 21. Drive mechanism 20 provides rotational motion to platen 11 about first axis 22, passing through center point 6 and essentially perpendicular to the plane defined by working surface 16. Platen drive mechanism 20 also includes at least one power source (not shown), for example an electric motor. This power source is linked either directly or indirectly to additional drive mechanism components (not shown) using conventional devices such as gears, belts, friction wheels, and the like.

A substrate carrier 36 having an attachment surface 38 holds and positions a substrate or wafer 40. Wafer 40 is positioned such that its active or device surface 42 is in contact with, and/or proximate to working surface 16. Also shown in FIG. 1 is a carrier motion mechanism 44 for moving active surface 42 laterally in a plane essentially parallel with the plane of working surface 16. Motion mechanism 44 is coupled to both carrier 36 and a power source (not shown) through a drive coupling 43. In addition to the aforementioned lateral motion, motion mechanism 44 also rotates wafer 40 about a second axis 46 essentially parallel to first axis 22. In some embodiments, this rotation is concentric about wafer 40, and in other embodiments it is eccentric. In some embodiments, both the speed and direction of rotation of wafer 40 are selectively variable.

FIG. 1 further illustrates examples of enhancements over existing systems offered by embodiments of the present invention that employ thinned region 14. In some embodiments, thinned region 14 is advantageously used to allow access to active surface 42 for an optical sensor device 50. Sensor device 50 is typically configured to measure the thickness of substrate 40 or of a layer disposed thereon. Thus, in some embodiments sensor device 50 is a reflectivity measuring sensor for monitoring reflectance based upon thin film interference, while in other embodiments, sensor device 50 is an interferometric type sensor for monitoring the position of the reflectance surface of the substrate through interferometry. In some embodiments sensor device 50 provides an input signal for in-situ continuous and end-point thickness monitoring. It will be understood, that such continuous in-situ thickness monitoring provides for dynamic process control as described in detail below.

To allow optical access by sensor device 50 to active surface 42 through thinned region 14, platen 11 consists partially or entirely of a material having good optical transparency and homogeneity. Polymethyl methacrylate (PMMA), fused silica, zerodur, and polycarbonate, for example, are suitable materials, which also exhibit desirable structural rigidity and mechanical toughness. Although in some embodiments entire platen 11 is optically transparent, it is required for only those portions of platen 11 underlying thinned regions 14 to be optically transparent. However, making substantially the entire platen 11 optically transparent advantageously provides flexibility in selecting the location of thinned region 14.

In further embodiments, portions of platen 11 underlying thinned regions 14 are rendered optically transparent by removing segments of platen 11 underlying thinned regions 14.

While FIG. 1 depicts a single sensor device 50, this is for illustrative purposes only. Thus in some embodiments of the present invention, multiple sensors are placed at differing positions below and adjacent single thinned region or multiple thinned regions 14. In addition, it will be realized that the one or more thinned regions 14 provided in embodiments of the invention allow for optical access to active surface 42.

Optionally, the apparatus depicted in FIG. 1 also incorporates a dynamic feedback system 52 for routing a signal 52*a* to a computing device 53. It will be understood that signal 52*a* is representative of any of a variety of signals, for example a system related signal from platen drive mechanism 20 representing rotational speed or angular velocity. Additionally, signal 52*a* can be a polishing effect signal, for example from a pH monitor, to represent a chemical change in the slurry composition or from a film thickness monitoring sensor, e.g. sensor device 50, to represent a specific film thickness at a point on active surface 42. Signal 52*a* is routed through dynamic feedback system 52 to computing device 53. In some embodiments, computing device 53 is a general purpose computing device having software routines encoded within its memory for receiving, and evaluating input signals such as signal 52*a*. In some embodiments, computing device 53 is a specific purpose computing device, essentially hardwired for a specific purpose, while in some embodiments, device 53 is some combination of general purpose and specific purpose computing devices.

Regardless of form, device 53 receives one or more input signals 52*a* and using routines encoded in its memory, outputs a result as one or more output signals 52*b*, 52*c*, 52*d*, and 52*e*. Each output signal 52*b*, 52*c*, 52*d*, and 52*e* can be a control signal for providing dynamic process control of one or more of the various sub-systems of the embodiments of the invention described herein.

Illustratively, an input signal 52*a* from in-situ optical thickness sensor device 50 enables computing device 53 to calculate a rate of removal of wafer surface 42. In turn, process variables, for example platen drive mechanism 20, a platen pressure mechanism 48, a slurry supply device 32, and/or carrier motion mechanism 44, can each be dynamically controlled based upon an input signal 52*a* received and evaluated by computing device 53. In some embodiments, one or more output signals 52*b*–52*e* are informational display or alert signals intended to call the attention of a human operator. For example, in some embodiments, computing device 53 can produce an output signal 52*b*–52*e* that signals a processing stoppage.

In addition to receiving and evaluating input signals 52*a* from sensing devices 50, computing device 53 is also capable of receiving process programming inputs from human operators or from other computing devices (not shown). In this manner, computing device 53 is used to control essentially all functions of embodiments of the CMP system of the invention.

Figure 2:
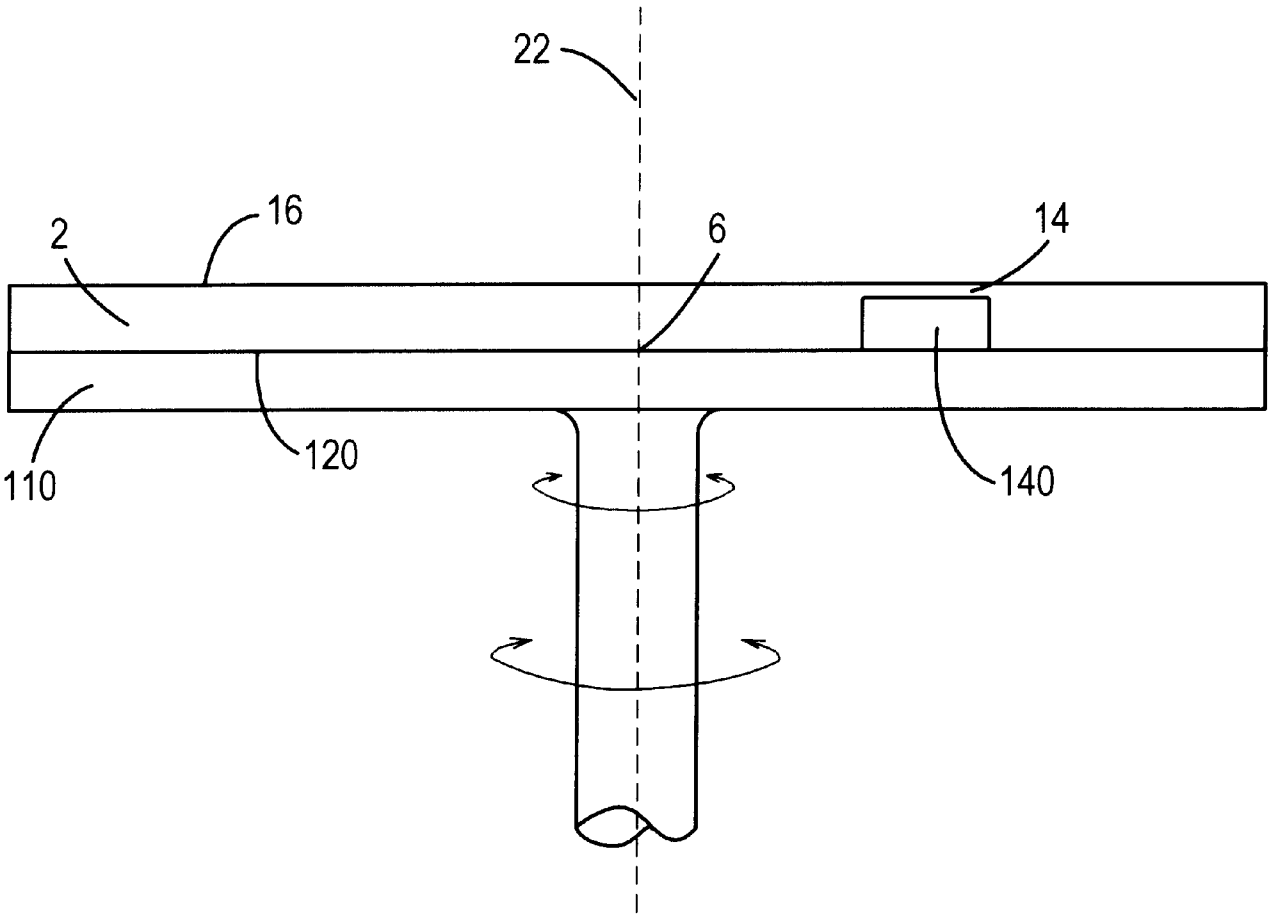
FIG. 2 is a cross-sectional view showing a portion of a further embodiment of a CMP apparatus having a thinned polishing pad in accordance with the invention.

FIG. 2 is a cross-sectional view showing a portion of a CMP apparatus having a thinned polishing pad in accordance with the invention. A platen 110 having a surface 120 with a raised portion 140 is rotatable about a perpendicular first axis 22 through a center point 6. A polishing pad 2 having a working surface 16 and a thinned region 14 is pasted or otherwise attached using conventional methods to surface 120 of platen 110 such that raised portion 140 is aligned with thinned region 14 of polishing pad 2. Polishing pad 2 is thinned from the side facing surface 120 of platen 110 to provide enhanced optical transparency and homogeneity, as well as to allow attachment of polishing pad 2 to surface 120 while maintaining an essentially planar working surface 16.

As described previously for platen 11, platen 110 also consists partially or entirely of a material having good optical transparency and homogeneity. For embodiments where platen 110 only partially consists of materials having good optical transparency and homogeneity, it will be understood that raised portion 140 comprises those optically transparent materials. In this manner, thinned region 14 and optically transparent raised portion 140 provide enhanced optical access for a sensor device to perform in-situ process monitoring, as previously described. It will be understood that just as in some embodiments polishing pad 2 contains thinned regions 14 that encompass different shapes, locations, or encompass distributed multiple thinned regions applied to single or multiple polishing pads 2, in some embodiments, platen 110 contains raised portions 140 that encompass different shapes, locations, or encompass distributed multiple thinned regions to be applied to platen 110.

One of ordinary skill in the art will understand that raised portions 140 provide enhanced alignment of polishing pads 2 and provide additional surface area for attachment or interlocking of polishing pads 2 to platens 110. Further, raised portions 140 provide mechanical support under thinned portions 14 of polishing pads 2 to prevent deformation of essentially planar working surface 16.

Finally, it will be understood that embodiments in accordance with the present invention that encompass platen 110 provide for all the in-situ process monitoring benefits of embodiments encompassing platen 11 and as previously described herein.

In view of the foregoing, it will be realized that embodiments of the present invention have been described, wherein an improved planarization system has been enabled. Embodiments of the present invention allow enhanced optical access to the substrate active surface being polished, as compared to prior art systems, thus allowing continuous in-situ monitoring of the planarization process, for example thickness and end point detection as well as dynamic process control.

What is claimed is:

1. An apparatus for chemical-mechanical planarization comprising:

a circular platen having a planar upper surface;

a polishing pad attached to said planar upper surface, said polishing pad having a working surface parallel to said planar upper surface, said polishing pad being thinned, thereby forming a recess in a first surface of said polishing pad and forming a thinned region adjacent a second surface of said polishing pad opposite said first surface; and a carrier positioned to hold an active substrate surface proximate to or in contact with said working surface, wherein said second surface is said working surface.

2. The apparatus of claim 1, wherein said thinned region is optically transmitting.

3. An apparatus for chemical-mechanical planarization comprising:

a circular platen having a planar upper surface;

a polishing pad attached to said planer upper surface, said polishing pad having a working surface parallel to said planar upper surface, said polishing pad being thinned, thereby forming a recess in a first surface of said polishing pad and forming a thinned region adjacent a second surface of said polishing pad opposite said first surface, wherein said thinned region is optically transmitting, wherein a portion of said platen underlying said thinned region is optically transparent;

a sensor device for monitoring a polishing effect optically through said thinned region; and a carrier positioned to hold an active substrate surface proximate to or in contact with said working surface.

4. The apparatus of claim 2, further comprising at least one sensor device for monitoring a polishing effect optically through said thinned region.

5. The apparatus of claim 4, wherein the portion of said platen underlying said thinned region is optically transparent.

6. The apparatus of claim 4, further comprising a feedback system coupled to said sensor device for controlling operation of said apparatus.

7. A method for surface planarization of a substrate comprising:

applying a polishing pad to a planar upper surface of a rotating platen, said polishing pad having a working surface parallel to said planar upper surface, said polishing pad being thinned, thereby forming a recess in a first surface of said polishing pad and forming a thinned region adjacent a second surface of said polishing pad opposite said first surface; and rotating said working surface against a substrate surface, wherein said second surface is said working surface.

8. The method of claim 7, further comprising:

monitoring said planarization of said substrate surface optically through said thinned region, wherein said surface planarization monitoring generates signals; and collecting said signals for continuous evaluation of said surface planarization.

9. The method of claim 8, further comprising:

generating dynamic feedback signals from said continuous evaluation; and using said dynamic feedback signals to continuously control said surface planarization.

10. An apparatus for chemical-mechanical planarization comprising:

a circular platen having an upper surface with a raised portion; and a polishing pad attached to said upper surface, said polishing pad having a planar working surface, said polishing pad being thinned, thereby forming a recess in a first surface of said polishing pad adjacent said upper surface and forming a thinned region adjacent a second surface of said polishing pad opposite said first surface, wherein said raised portion is aligned and interlocked with said recess.

11. The apparatus of claim 10, wherein said thinned region is optically transmitting.

12. The apparatus of claim 11, further comprising at least one sensor device for monitoring a polishing effect optically through said thinned region.

13. The apparatus of claim 12, wherein the portion of said platen including and underlying said raised portion is optically transparent.

14. The apparatus of claim 12, further comprising a feedback system coupled to said sensor device for controlling operation of said apparatus.

15. A method for surface planarization of a substrate comprising:

applying a polishing pad to an upper surface of a rotating platen having a raised portion, said polishing pad having a planar working surface parallel to said planar upper surface, said polishing pad being thinned, thereby forming a recess in a first surface of said polishing pad adjacent said upper surface and forming a thinned region adjacent a second surface of said polishing pad opposite said first surface, wherein said raised portion is aligned with and protruding into said recess; and rotating said working surface against a substrate surface.

16. The method of claim 15, further comprising:

monitoring said planarization of said substrate surface optically through said thinned region, wherein said surface planarization monitoring generates signals; and collecting said signals for continuous evaluation of said surface planarization.

17. The method of claim 16, further comprising:

generating dynamic feedback signals from said continuous evaluation; and using said dynamic feedback signals to continuously control said surface planarization.

* * * * *